US008302806B1

(12) United States Patent
Gibbar

(10) Patent No.: US 8,302,806 B1
(45) Date of Patent: Nov. 6, 2012

(54) DRINK VESSEL HOLDER

(76) Inventor: James M. Gibbar, O'Fallon, IL (US)

( * ) Notice: Subject to any disclaimer, the term of this patent is extended or adjusted under 35 U.S.C. 154(b) by 1426 days.

(21) Appl. No.: 10/252,181

(22) Filed: Sep. 23, 2002

(51) Int. Cl.
*B65D 3/28* (2006.01)

(52) U.S. Cl. ..... 220/738; 248/683

(58) Field of Classification Search ..... 229/402, 229/400; 220/574.1, 346, 738, 720, 742, 220/722; 206/217, 813, 460; 248/346.11, 248/683, 205.3; 16/425
See application file for complete search history.

(56) References Cited

U.S. PATENT DOCUMENTS

| | | | | | |
|---|---|---|---|---|---|
| 2,131,878 | A | * | 10/1938 | Lawrence | 215/394 |
| 2,163,309 | A | * | 6/1939 | McConnell | 215/394 |
| 2,213,666 | A | * | 9/1940 | Burke | 283/81 |
| 2,845,207 | A | * | 7/1958 | Klinghoffer | 220/23.83 |
| 2,954,868 | A | * | 10/1960 | Swedish, Jr. et al. | 428/153 |
| 3,367,610 | A | * | 2/1968 | Lindquist | 248/110 |
| 3,512,458 | A | * | 5/1970 | Ehe | 493/114 |
| 3,698,551 | A | * | 10/1972 | Tomlinson | 206/489 |
| 3,739,975 | A | * | 6/1973 | Davidow | 229/116.3 |
| 3,847,324 | A | * | 11/1974 | Uchanski et al. | 220/737 |
| 3,915,296 | A | * | 10/1975 | Spencer | 206/217 |
| 3,994,089 | A | * | 11/1976 | Schwartz | 40/310 |
| 4,781,957 | A | * | 11/1988 | Brown et al. | 428/43 |
| 4,966,297 | A | * | 10/1990 | Doty | 220/23.83 |
| 5,413,302 | A | * | 5/1995 | Ferster | 248/346.11 |
| 5,702,128 | A | * | 12/1997 | Maxim et al. | 283/81 |
| 6,022,570 | A | * | 2/2000 | Richmond | 426/120 |
| 6,193,201 | B1 | * | 2/2001 | Babcock | 248/311.2 |
| 6,609,625 | B1 | * | 8/2003 | Gibbar | 220/574 |
| 6,641,910 | B1 | * | 11/2003 | Bries et al. | 428/343 |
| 6,672,817 | B2 | * | 1/2004 | Denny | 426/110 |
| 6,691,890 | B1 | * | 2/2004 | Persson | 220/575 |
| 6,769,541 | B1 | * | 8/2004 | Carriere | 206/348 |

* cited by examiner

*Primary Examiner* — Anthony Stashick
*Assistant Examiner* — Christopher McKinley
(74) *Attorney, Agent, or Firm* — Peter Loffler

(57) ABSTRACT

A drink vessel holder holds a drink vessel on a target surface such as a plate of food allowing the user to hold both the plate and the drink vessel held thereon with the same hand in order to allow the other hand to be used for enjoyment of the products being held. The drink vessel holder has a flexible body member with an upper portion with a first top surface and a first bottom surface and a lower portion with a second top surface and a second bottom surface with an adhesive material disposed on the first bottom surface of the upper portion.

10 Claims, 2 Drawing Sheets

DRINK VESSEL HOLDER

BACKGROUND OF THE INVENTION

1. Field of the Invention

The present invention relates to a device that holds a drink vessel which can rest on a plate or other surface allowing the user to maintain the drink vessel firmly thereon with one hand.

2. Background of the Prior Art

Most parties and other similar social occasions serve both food and drink. Obviously, the food is placed onto a plate while the drink is held within a drink vessel such as a cup, a can, or a glass. This very straightforward method, while very efficient in its containment performance, does have its drawbacks.

If the social occasion is such that food and drink are retrieved from one or more central serving stations, and upon retrieval of the bounty, the user returns to a seat at a table, the separate plate and drink vessel tend to be satisfactory for most such occasions. The problem arises when it is desired that the party attendee not return to a table for consumption of the food and drink being served. Such lack of desired destination can occur when the party host lacks sufficient sit down facilities to accommodate all of the guests. More typically, it is the host's desire to keep the attendees on their feet in order to keep such attendees moving in order to facilitate dynamic guest interaction.

As the guest must hold the food filled plate with one hand and the drink vessel with the other, this desire to keep a large portion of the guests on their feet at any given time, presents some problems. Although sipping a drink presents few problems, having both hands full makes the consumption of the food on the plate a tricky occurrence. The guest may sit at a table to consume both food and drink in relative comfort. However, either by necessity or by design, the availability of sitting locations may be at a premium, and many guests do not want to sit and want to mingle even while eating and drinking. The guest may find a location, such as a table, onto which either the plate or the drink vessel may be placed, thereby freeing one hand allowing for proper maneuverability between plate and drink vessel. However, this may also be problematic due to the limited availability, either by necessity or by design, of such rest areas available to the guest. Furthermore, this method also tends to tie down the guest, although not necessarily as much as sitting at a table.

Another method used to overcome the problem of having both hands full, is for the guest to retrieve their food or drink initially, and upon consumption of the initial item, to retrieve the other item in order to consume food and drink in sequential fashion. While this method will work as planned, most guests desire to have a drink during, as opposed to before or after, food consumption. Additionally, this arrangement throws into disarray parties that are designed for the intermingling of food and drink such as wine and cheese parties or beer and pretzel parties.

One other method employed by many guests is to attempt to hold the food plate and the drink vessel with one hand and to use the other hand to facilitate enjoyment of the consumables. While many guests may prove to be quite adept at succeeding with such maneuverability, other guests will proceed with disastrous and embarrassing results.

In order to facilitate the ability of a guest to be able to enjoy food and drink simultaneously without the need to sit at a table or to place either the food bearing plate or the drink vessel onto a fixed surface and without the need to perform heroic acrobatics, combined plate and drink vessel holders have been proposed. Such prior art devices are designed to serve as a plate in order to hold food and are also designed to hold a drink vessel so that a user can hold the food bearing plate and drink vessel with one hand so that the other hand may facilitate the enjoyment of the food and drink. Such prior art devices come in a variety of designs and work with varying degrees of efficiency, however, they tend to suffer from one or more drawbacks.

Many such food plate and drink vessel holding devices perform their intended task with great efficiency, yet such devices are unduly complex in design and construction, making such devices unusually expensive to employ. As these devices tend to be disposable, a high cost device is unjustified in most settings. Other prior art devices have the ability to hold only a specific type of drink vessel, making the utility of such devices limited in many situations. Still other devices require certain steps to be taken for proper device usage, which steps may not be obvious to a device novice guest, rendering such devices awkward in operation with the potential for device failure and the attendant embarrassment that results.

Therefore, there exists a need in the art for a device that serves as a drink vessel holder which can be used with any plate or other surface, overcoming the above mentioned problems found in the art. Specifically, such a device must be of relatively simple and straightforward design and construction and must be relatively easy to manufacture. Such a device must be able to accommodate a large variety of drink vessels that are commonly found at parties. Use of such a device must be quick and easy and the chance for potential disaster during device usage must be relatively small.

SUMMARY OF THE INVENTION

The drink vessel holder of the present invention addresses the aforementioned needs in the art. The drink vessel holder is a device that allows a user to hold a drink vessel on a target surface, such as a plate, with the one hand so that the other hand may be employed to enjoy both food and drink. The drink vessel holder is of relatively simple and straightforward design and construction and is relatively easy to manufacture, employing standard manufacturing techniques. The drink vessel holder is able to accommodate a large variety of drink vessels that are commonly found at parties and other social occasions. Use of such a drink vessel holder is quick and easy, even to a device novice, rendering the chance for potential disaster during device usage relatively small.

The drink vessel holder of the present invention is comprised of a flexible body member that has an upper portion with a first top surface and a first bottom surface and a lower portion with a second top surface and a second bottom surface. An adhesive material is disposed on the first bottom surface of the upper portion. The upper portion is generally rectangular in shape while the lower portion is generally circular in shape with the upper portion and the lower portion connected by a neck. The upper portion is adhesively connected to a drink vessel while the lower portion rests on the target surface and is held thereat by the user's thumb.

BRIEF DESCRIPTION OF THE DRAWINGS

Similar reference numerals refer to similar parts throughout the several views of the drawings.

DESCRIPTION OF THE PREFERRED EMBODIMENT

Figure 1:
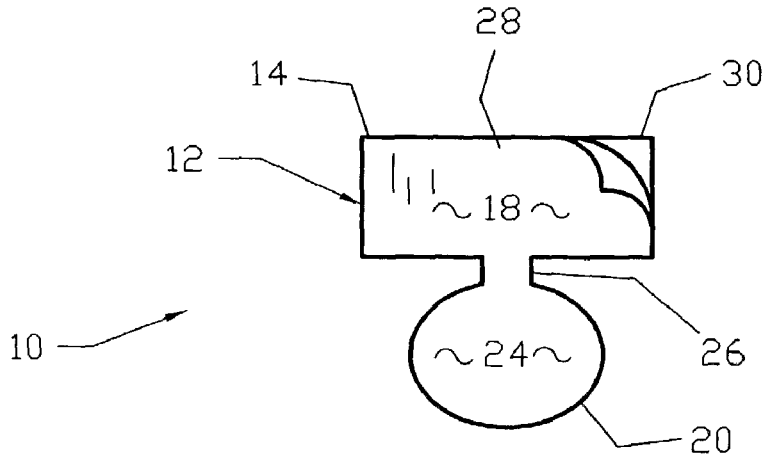
FIG. 1 is a bottom plan view of the drink vessel holder of the present invention.
Figure 2:
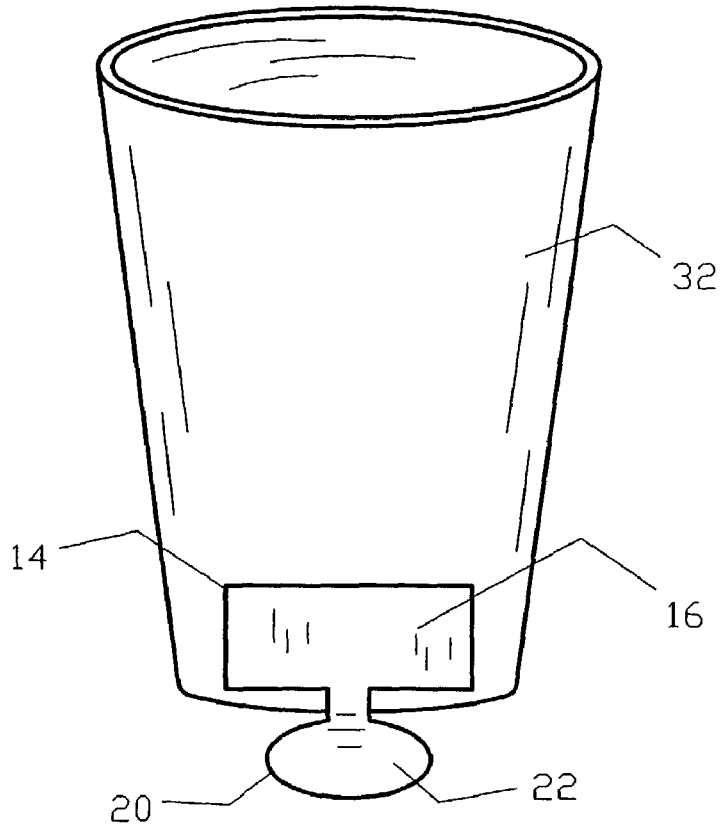
FIG. 2 is a perspective view of the drink vessel holder attached to a drink vessel.
Figure 3:
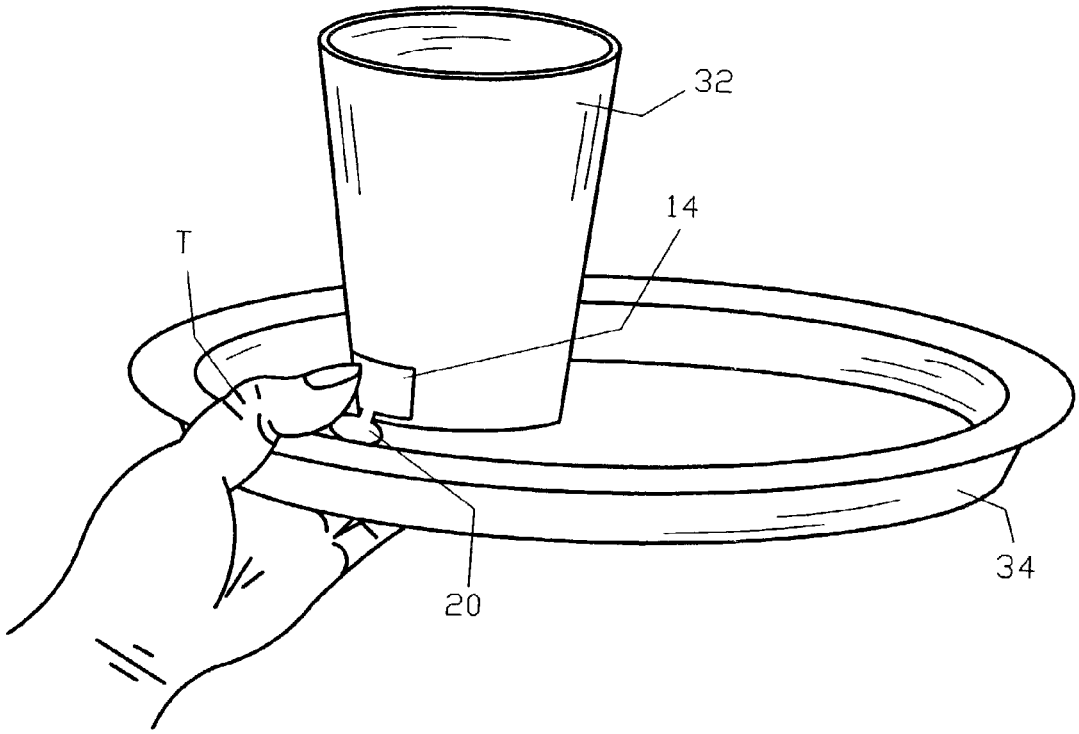
FIG. 3 is an environmental view of the drink vessel holder being used by a party attendee.

Referring now to the drawings, it is seen that the drink vessel holder of the present invention, generally denoted by reference numeral 10, is comprised of a thin and flexible body member 12 that has an upper portion 14 with a first top surface and a first bottom surface 18 and a lower portion 20 with a second top surface 22 and a second bottom surface 24. The upper portion 14 is generally rectangular in shape while the lower portion 20 is generally circular in shape with the upper portion and the lower portion being connected by a neck 26. The body member 12 is made from an appropriate flexible material such as flexible plastic, Nylon, reinforced paper, etc. The material must be flexible enough to allow the upper portion 14 to bend at least 90 degrees with respect to the lower portion 20 without tearing yet must be strong enough so it does not rip in use even if the flexible member 12 gets wet.

An adhesive material 28 is disposed on the first bottom surface 18 of the upper portion 14, either covering the entire first bottom surface 18 or a portion thereof. A peel away protective layer 30 is disposed on the first bottom surface 18 in order to protect the adhesive material 28.

In order to use the drink vessel holder 10, the protective layer 30 is removed from the upper portion 14 in order to expose the adhesive material 28. The first bottom surface 18 of the upper portion 14 is pressed onto a drink vessel 32, proximate the vessel's bottom, so as to adhesively attach to the drink vessel 32. The lower portion 20 of the body member 12 is placed so as to rest onto the target surface 34 onto which the drink vessel 32 is to be held. The user's thumb T or other finger helps press and maintain the lower portion 20 on the target surface 34 so as to help maintain the drink vessel 32 thereon and upright. The rectangular shape of the upper section 14 assures a solid point of contact between the upper section 14 and the drink vessel 34, while the circular shape of the lower section 20 conforms to the shape of the user's thumb T at the point of contact with the lower section 20. The target surface 34 may be the illustrated plate or any other surface onto which a user desires to hold the drink vessel 34, for example, a jetliner's fold down tray. The peel strength of the adhesive material 28 is sufficiently high so as to maintain firm adhesive contact with its respective device, even if some moisture is present.

While the invention has been particularly shown and described with reference to embodiments thereof, it will be appreciated by those skilled in the art that various changes in form and detail may be made without departing from the spirit and scope of the invention.

I claim:

1. A holder comprising:

a flexible body member having an upper portion with a first flat top surface and a first flat bottom surface and a lower portion with a second top surface and a second bottom surface, the first bottom surface and the second bottom surface forming an overall lower surface;

an adhesive material disposed only on the first bottom surface of the upper portion;

a drink vessel having an open top and a bottom and an outer surface; and wherein the first bottom surface of the upper portion is adhesively attached to the outer surface of the drink vessel proximate the bottom and the bottom of the drink vessel is adapted to gravitationally horizontally rest on a surface, and the second bottom surface is adapted to non-adhesively and gravitationally horizontally rest on the surface with a user's thumb or finger resting on the second top surface in order to press the lower portion onto the target surface.

2. The holder as in claim 1 wherein the upper portion is connected to the lower portion by a neck.

3. The holder as in claim 1 wherein the upper portion is generally rectangular in shape.

4. The holder as in claim 3 wherein the lower portion is generally circular in shape.

5. The holder as in claim 4 wherein the upper portion is connected to the lower portion by a neck.

6. A holder comprising:

a flexible body member having an upper portion with a first flat top surface and a first flat bottom surface and a lower portion with a second top surface and a second, bottom surface, the first bottom surface and the second bottom surface forming an overall lower surface;

an adhesive material disposed only on the first bottom surface of the upper portion;

a drink vessel having an open top and a bottom;

a plate; and wherein the first bottom surface of the upper portion is adhesively attached to the drink vessel proximate the bottom and the bottom of the drink vessel is adapted to gravitationally horizontally rest on the plate, and the second bottom surface non-adhesively gravitationally horizontally rests on the plate with a user's thumb or finger resting on the second top surface in order to press the lower portion, onto the plate.

7. The holder as in claim 6 wherein the upper portion is connected to the lower portion by a neck.

8. The holder as in claim 6 wherein the upper portion is generally rectangular in shape.

9. The holder as in claim 8 wherein the lower portion is generally circular in shape.

10. The holder as in claim 9 wherein the upper portion is connected to the lower portion by a neck.

* * * * *